US007577235B2

(12) United States Patent
Jedlitschka

(10) Patent No.: US 7,577,235 B2
(45) Date of Patent: Aug. 18, 2009

(54) VOLTAGE GENERATOR OF A RADIATION GENERATOR

(75) Inventor: Hans Jedlitschka, Chatillon (FR)

(73) Assignee: General Electric Company, Schenectady, NY (US)

( * ) Notice: Subject to any disclaimer, the term of this patent is extended or adjusted under 35 U.S.C. 154(b) by 91 days.

(21) Appl. No.: 11/971,432

(22) Filed: Jan. 9, 2008

(65) Prior Publication Data

US 2009/0175419 A1 Jul. 9, 2009

(51) Int. Cl.
*H05G 1/32* (2006.01)
*H05G 1/10* (2006.01)

(52) U.S. Cl. ..... 378/111; 378/101

(58) Field of Classification Search ..... 378/119, 378/101–114

See application file for complete search history.

(56) References Cited

U.S. PATENT DOCUMENTS 5,257,304 A 10/1993 Sireul et al.
5,808,376 A * 9/1998 Gordon et al. ..... 307/66
6,100,750 A 8/2000 Van Der Zee
7,375,993 B2 * 5/2008 Beland ..... 363/71
7,397,896 B2 * 7/2008 Beyerlein ..... 378/107
2004/0247080 A1 * 12/2004 Feda ..... 378/101

FOREIGN PATENT DOCUMENTS

GB 2406916 9/2004
WO WO2004036745 4/2004

* cited by examiner

*Primary Examiner*—Irakli Kiknadze

(57) ABSTRACT

A voltage divider of a voltage generator is provided. The divider comprises an input terminal opposite an output terminal, a measurement resistor electrically connected in series between the input terminal and the output terminal, a footer resistor electrically connected in parallel between the output terminal and electrical ground, and a footer capacitor electrically connected in parallel between the output terminal and electrical ground. A value of the footer resistor is at least a magnitude smaller relative to a value the measurement resistor. The divider further includes a reactive bypass component having a first end electrically connected in parallel to the measurement resistor.

20 Claims, 4 Drawing Sheets

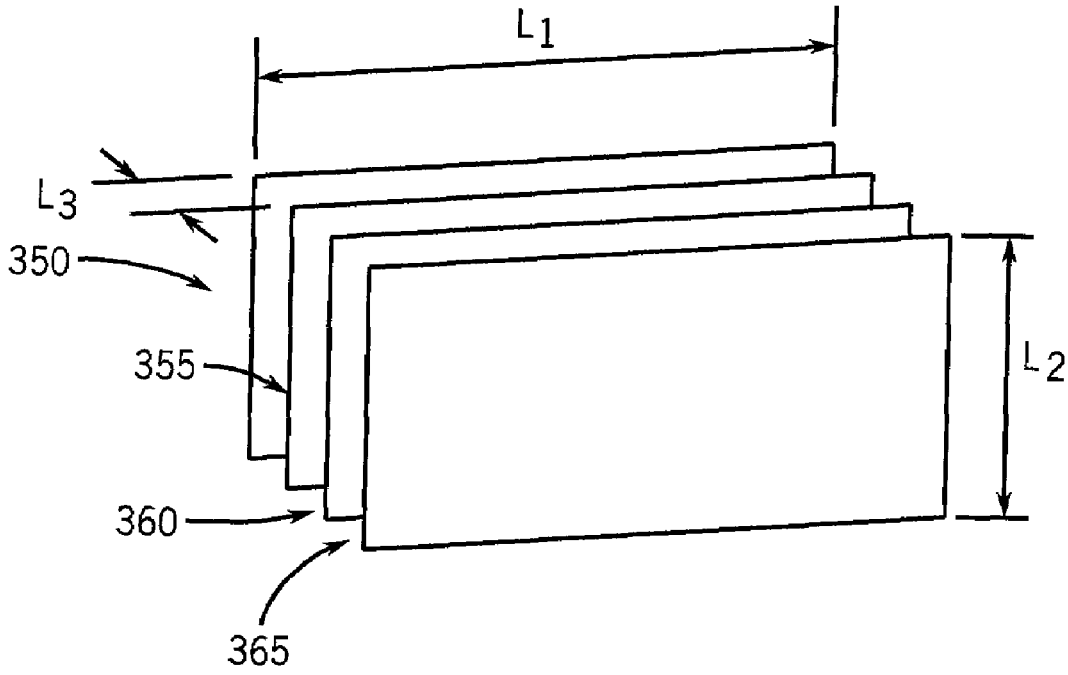
FIG. 3
FIG. 4
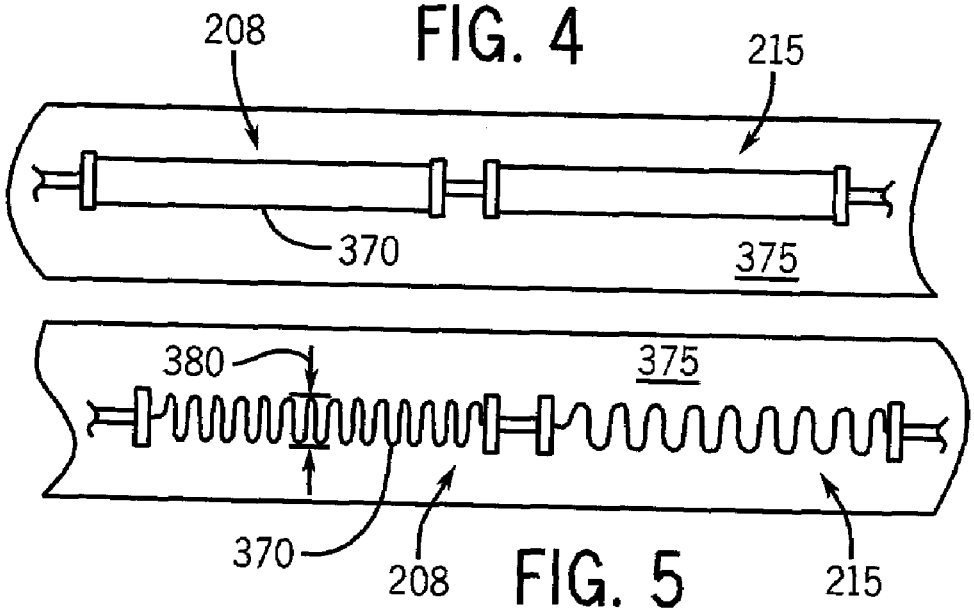
FIG. 5

VOLTAGE GENERATOR OF A RADIATION GENERATOR

FEDERALLY SPONSORED RESEARCH OR DEVELOPMENT

[NOT APPLICABLE]

CROSS REFERENCE TO RELATED APPLICATIONS

[NOT APPLICABLE]

BACKGROUND OF THE INVENTION

The subject matter described herein generally relates to a radiation generator, and more particularly, to a voltage divider for a high speed, high voltage generator for a radiation generator of a radiological imaging system.

Various types of radiation generators have been developed so as to generate electromagnetic radiation. The electromagnetic radiation thus generated can be utilized for various purposes including medical imaging. One such example of a radiation generator is an X-ray generator. A typical X-ray generator generally comprises an X-ray tube for generating electromagnetic radiation (For example, X-rays), a power supply circuit configured to energize the X-ray tube in a conventional manner so as to emit X-rays through a port and toward a target.

The power supply circuit of a conventional X-ray generator generally includes a high voltage generator configured to supply high voltage power so as to energize the X-ray tube.

BRIEF DESCRIPTION OF THE INVENTION

There exists a need to provide a high voltage generator to increase the rate to energize an X-ray tube of a radiological imaging system. The high voltage generator should be readily sourced and manufactured at a low price. The radiation generator should include a voltage generator operable to work with DC or AC electrical power of very high bandwidth and voltage levels. The voltage generator should also be able to operate with high precision over a wide range of temperature, should be compact in size. In particular, the voltage generator should include a measurement portion that can be mounted independently of sources of undesired electrical noise. The above-mentioned needs and desires are addressed by the subject matter described herein.

An embodiment of a voltage divider of a voltage generator is provided. The divider comprises an input terminal opposite an output terminal, a measurement resistor electrically connected in series between the input terminal and the output terminal, and a footer resistor electrically connected in parallel between the output terminal and electrical ground. A value of the footer resistor is at least a magnitude smaller relative to a value the measurement resistor. The divider further includes a footer capacitor electrically connected in parallel between the output terminal and electrical ground, and a reactive bypass component having a first end electrically connected in parallel to the measurement resistor.

An embodiment of a radiation generator is provided. The radiation generator comprises a radiation source operable to generate an electromagnetic radiation, the radiation source comprising an anode and a cathode; and a voltage generator electrically coupled to provide electrical power to energize the radiation source. The voltage generator comprises an input terminal opposite an output terminal, a measurement resistor electrically connected between the input terminal and the output terminal, a footer resistor electrically connected in parallel between the output terminal and electrical ground, and a footer capacitor electrically connected in parallel between the output terminal and electrical ground. A value of the footer resistor at least a magnitude smaller relative to a value the measurement resistor. The voltage generator further includes a reactive portion having a first end electrically connected in parallel to the measurement resistor.

An embodiment of a voltage divider of a voltage generator is also provided. The divider comprises an input terminal opposite an output terminal, and a measurement resistor electrically connected in series between the input terminal and the output terminal. The measurement resistor comprises a series of spaced apart portions of resistive material electrically connected to one another, the series of spaced apart portions of resistive material located at a generally uniform distance from electrical ground. The divider also comprises a footer resistor electrically connected in parallel between the output terminal and an electrical ground, and a footer capacitor electrically connected in parallel between the output terminal and the electrical ground.

Systems and methods of varying scope are described herein. In addition to the aspects and advantages described in this summary, further aspects and advantages will become apparent by reference to the drawings and with reference to the detailed description that follows.

BRIEF DESCRIPTION OF THE DRAWINGS

FIG. 3 illustrates an embodiment of a construction of a voltage divider portion that constitutes the measurement portion of the voltage generator in FIG. 1.

FIG. 4 illustrates one embodiment of the construction of the resistors of the divider in FIG. 2 placed on a ceramic substrate, the resistors linear-shaped.

FIG. 5 illustrates another embodiment of the construction of the resistors of the divider in FIG. 2 placed on a ceramic substrate, the resistors meandering shaped.

DETAILED DESCRIPTION OF THE INVENTION

In the following detailed description, reference is made to the accompanying drawings that form a part thereof, and in which is shown by way of illustration specific embodiments, which may be practiced. These embodiments are described in sufficient detail to enable those skilled in the art to practice the embodiments, and it is to be understood that other embodiments may be utilized and that logical, mechanical, electrical and other changes may be made without departing from the scope of the embodiments. The following detailed description is, therefore, not to be taken in a limiting sense.

Figure 1:
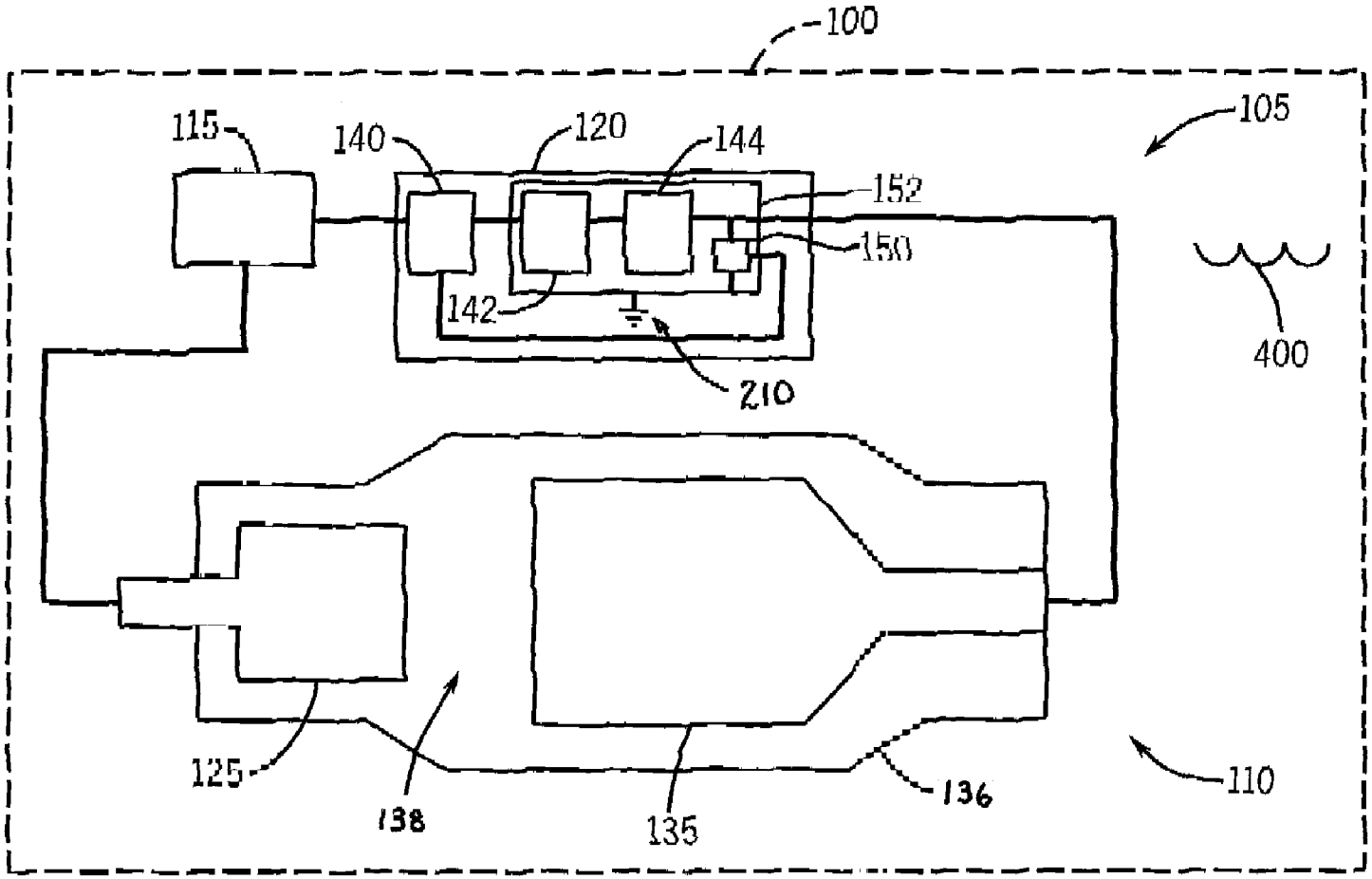
FIG. 1 shows a schematic diagram of an embodiment of a radiation generator that includes a high voltage generator.

FIG. 1 shows an embodiment of a system 100 that includes a radiation generator 105. Examples of the system 100 include a security system, a radiological imaging system, etc. The radiation generator 105 generally includes a radiation source 110 configured to generate or cause emission of radiation. In the illustrated embodiment, the radiation generator 105 is an X-ray generator, and the radiation source 110 is an X-ray tube. A power source 115 in combination with a high voltage generator 120 is electrical connected to energize the radiation source 110 so as to generate X-rays.

The illustrated radiation source 110 generally includes a cathode 125 located, in general alignment along a central longitudinal axis of the radiation source 110, opposite an anode 135. A vacuum housing 136 encloses the cathode 125 and anode 135, and the cathode 125 and anode 135 are separated by a vacuum gap 138 located therebetween. An embodiment of the power source 115 is configured to provide AC power to the high voltage generator 120. Alternatively, the power source 115 can be generally configured to provide DC power to the high voltage generator 120.

An embodiment of the cathode 125 generally includes a drive circuit electrically connected to cause an electron-emitting filament in a conventional manner to emit accelerated electrons or an electron beam toward a target at the anode in a conventional manner. The energized filament is generally heated to incandescence so as to release the accelerated electrons in direction to collide with the target at the anode 135. In response to the impact of the electron beam, the anode 135 produces or generates X-ray radiation.

The power source 115 is electrically connected so as to energize the high voltage power generator 120 in a conventional manner to supply electrical power so as to cause the emission of radiation (e.g., X-rays) from the radiation source 110. The high voltage power generator 120 communicates electrical power to the drive current circuit so as to energize the electron-emitting filament of the cathode 125 in a conventional manner to generate an electron beam toward the anode 135. The high voltage power generator 120 also communicates high voltage potentials of generally equal magnitude (e.g., in the range of 50 to 250 kilovolts) and yet opposite polarity so as to bias or direct or target emission of the electron beam from the cathode 125 toward a target of the anode 135. The value of the voltage potential can vary. The influence of the bias voltages generated by the high voltage creates electrostatic forces so as to control the size and deflection of the electron beam in a conventional manner so as to selectively control the location of the focal spot of the electron beam in a selective manner.

Still referring FIG. 1, an embodiment of the high voltage power generator (e.g., monopolar generator) 120 includes a converter 140, a transformer 142, a rectifier 144, and a divider 150 operable to sample the level of high voltage potential transmitted from the voltage generator 120 to energize the radiation source 110. The transformer 142, rectifier 144 and divider 150 are generally located in a grounded enclosure 152 that may include an insulating fluid. Feedback signals from the divider 150 generally are generally processed or analyzed to cause regulation of the transmission of high voltage electrical power delivered to the radiation source 110 and thereby, inter alia, control targeting of the generated electron beam to create the transmission of radiation as well as and control the energy of the generated radiation by the radiation source 110.

Figure 2:
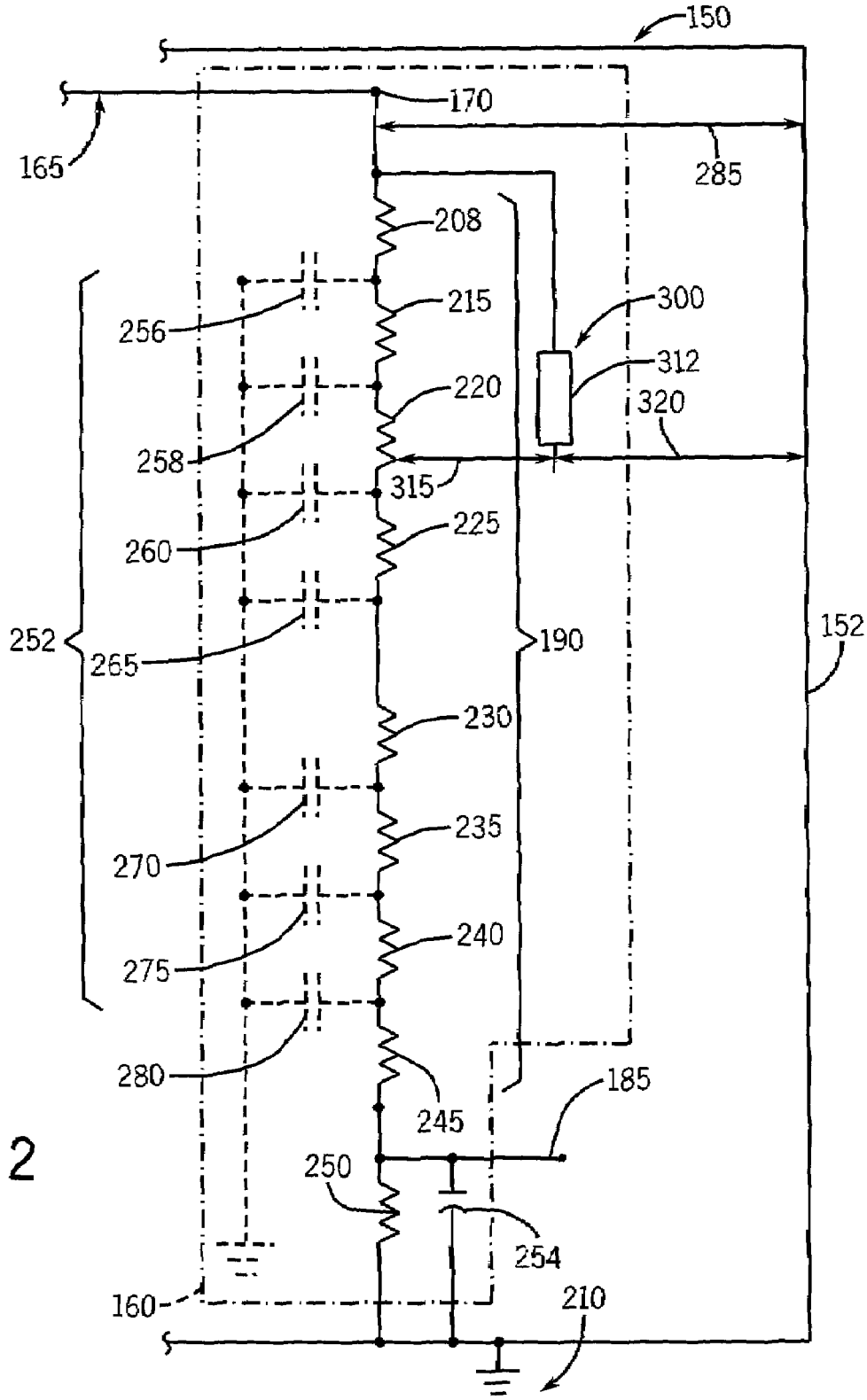
FIG. 2 shows a schematic diagram of an embodiment of a measurement portion of a voltage generator of FIG. 1.

Referring now to FIG. 2, an embodiment of the divider 150 includes an arrangement 160 generally configured to sample an output voltage potential at an output terminal reduced to about $1/10000^{th}$ of the voltage potential delivered to the radiation source 110. The voltage divider arrangement 160 is also configured to reduce the transient time of undesired oscillations in the voltage potential to be measured or sampled.

An embodiment of the arrangement 160 includes having a first end 165 with an input terminal 170. The input terminal 170 is generally electrically connected to receive the electrical power to be sampled. A second end 180 of the voltage divider arrangement 160, located generally opposite the first end 165, includes the output terminal 185. An embodiment of the arrangement 160 further includes a series of electrical components (e.g., resistors and capacitors described below) electrically connected between the input terminal 165 and output terminal 185.

According to one embodiment of the arrangement 160, the input terminal 170 is electrically connected in series with a measurement resistor 190. One end of the measurement resistor 190 may be common with the input terminal 170, or the measurement resistor 190 electrically connected nearest the input terminal 170 relative to a remainder of the arrangement 160. An embodiment of the measurement resistor 190 has a value of about 100 to 500 mega-ohms, for example. Yet, the value of the measurement resistor 190 can vary. One embodiment of the measurement resistor 190 is comprised of a succession of resistors or resistive elements 208, 215, 220, 225, 230, 235, 240, and 245 electrically connected in series with one another between the input terminal 170 and the output terminal 185. The succession of resistors 208, 215, 220, 225, 230, 235, 240, and 245 are also generally arranged or located in a generally linear alignment relative to one another between the input and output terminals 170, 185. Of course, the number of value of the series of resistors 208, 215, 220, 225, 230, 235, 240, and 245 that comprise the measurement resistor 190 can vary.

The arrangement 160 also includes a second resistor 250 generally electrically connected in parallel with the output terminal 185, and is generally electrically connected between the output terminal 185 and electrical ground 210, and is commonly referred to as the footer resistor. An embodiment of the footer resistor 250 is of a value of about ten to forty kilo-ohms, for example. Yet the value of the footer resistor 250 can vary. Although the footer resistor 250 is shown of a single or integral construction, the footer resistor 250 can comprise a series of resistive elements similar to that shown for the measurement resistor 190. The arrangement of the resistors 190 and 250 relative to the input and output terminals 170 and 185 is such that the sampled or measured voltage potential at the output terminal 185 is about one ten-thousandth ($1/10{,}000$) of the voltage received at the input terminal 170. Yet, the reduction in the voltage potential caused by the voltage divider arrangement 160 can vary.

The above-described succession of resistors 208, 215, 220, 225, 230, 235, 240, 245, 250 also can create an increased probability of stray parasitic capacitance, herein referred to with reference 252, that can cause undesired distortion of and increased transient time of the sampled voltage transmitted at the output terminal 185. The stray parasitic capacitance 252 is illustrated as a succession of capacitors 256, 258, 260, 265, 270, 275, 280 associated with each resistor 205, 215, 220, 225, 230, 235, 240, 245, 250 respectively, for sake of description. For example, an embodiment of each of the succession of resistors 208, 215, 220, 225, 230, 235, 240, and 245 may be constructed of a resistive material printed or layered on an insulator substrate such as alumina or other electrical insulation/thermal conductive ceramic. Such location of the linear alignment or arrangement of resistors 208, 215, 220, 225, 230, 235, 240, 245, 250 relative to the location of the grounded enclosure 152 or electrical ground 210 is proportional to the introduction or creation of stray parasitic capacitance to the voltage divider 150. For example, reducing an offset distance 285 of the linear alignment of one or more of the resistors 208, 215, 220, 225, 230, 235, 240 245, 250 relative to the electrical housing 152 or electrical ground 210 can reduce the introduction of parasitic capacitance to the voltage divider arrangement 160. Yet, there is minimum requirement of the offset distance 285 between the linear alignment of resistors 208, 215, 220, 225, 230, 235, 240 245, 250 relative to the grounded enclosure or housing 152 or electrical ground 210 to receive insulative packing therebetween that may be desired to reduce a likelihood of arcing or sparking by the high electrical voltages associated with operation of the high voltage generator 120. The stray parasitic capacitance 252 associated with the succession of resistors 205, 215, 220, 225, 230, 235, 240, 245, 250 can create an increased likelihood of an increased transient time to reach a generally stable sampled voltage control signal, or an undesired overshot 253 (See FIG. 6) in the sampled high voltage control signal above a generally stable voltage control signal potential.

To reduce or remove an effect of the above-described parasitic capacitance, the voltage divider arrangement 160 further includes a first end of a footer capacitor 254 electrically connected in parallel with the output terminal 185 and the footer resistor 250. The other end of the footer capacitor 254 is electrically connected to the electrically grounded housing 152 or electrical ground 210.

An embodiment of size or value of the foot capacitor 254 generally correlates to greater control over the sampled high voltage potentials fed back to the converter 140, thereby better control over the high voltage potentials transmitted from the voltage generator 120 to the radiation source 110. An embodiment of the value of the footer capacitor 254 is sized to improve or increase linearity and control over undesired transient effects that may be realized in the short, large pulse of voltage potential to be measured.

An embodiment of the footer capacitor 254 includes a film type construction so as to mount or be supported on an insulative medium (e.g., ceramic). An embodiment of the film type construction is comprised of at least two metallic films or strips that sandwich an insulative material therebetween. The number, width, and thickness of metallic or insulating strips or films can vary with the desired value of capacitance. The metallic strips can be created from print screening, or by bonding metal film on the insulating film, or by vapour deposition of the metallic material on the substrate. The type of metallic material (e.g., aluminum, copper, tin, etc.) can vary. Yet, the type of construction of the capacitor 254 can vary. Likewise, an embodiment of the footer resistor 250 and succession of resistors 208, 215, 220, 225, 230, 235, 240, 245, 250 can vary in shape (e.g., wavy, linear, round, etc.), construction (e.g., film), and size.

The divider 150 further includes a reactive portion 300. FIG. 2 shows one end of the reactive portion 300 is connected in parallel between the input terminal 170 and the measurement resistor 190. Yet, the reactive portion 300 can be connected in parallel either upstream or downstream of the measurement resistor 190. A technical effect of the reactive bypass 300 is to compensate for voltage losses in the high frequency range from the sampled voltage control signal. The loss of the voltage in the high frequency range (e.g., first harmonic range relative to third and fifth harmonics) can be associated with absorption by the undesired stray capacitive leakage generally introduced or created at the linear arrangement 160 of the series of resistors 208, 215, 220, 225, 230, 235, 240 245, 250 upstream of the reactive portion 300. To compensate for this voltage loss in the upper frequency range, the reactive bypass 300 is generally operable to inject voltages in the high frequency range to the voltage control sample signal, as controlled by, inter alia, a distance of the reactive bypass 300 relative to the grounded housing 152 or electrical ground 210. Another technical effect of the reactive portion 300 is to increase the bandwidth of the divider 150. The reactive portion 300 also reduces the time, or increases the ramp up speed, of the sampled voltage control signal from zero to a stable sample voltage control signal value, as communicated from the output terminal 185 and fed back to the converter 140 so as to regulate the transmission of voltage power from the voltage generator 120 to the radiation source 110 (e.g., x-ray tube).

Figure 6:
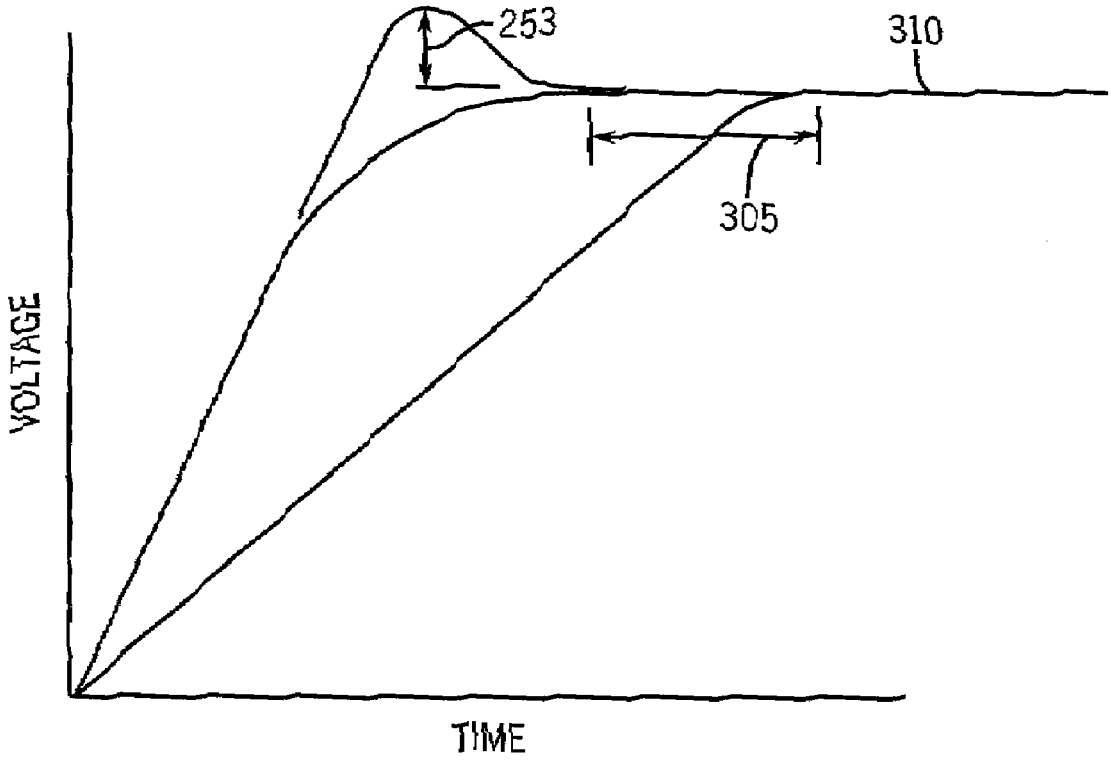
FIG. 6 illustrates an embodiment of the experimental results showing enhancing in the performance with using the divider of FIG. 2.

Referring to FIG. 6, experiments have shown that the above-described construction of the voltage generator 120 with the reactive portion 300 reduces a transient time (illustrated by arrow and reference 305) to reach a predetermined stable voltage control signal amplitude 310 at the output terminal 185 from about 1 millisecond time delay to about a 200 microseconds time delay. By reducing the transient time 305 to reach the stable sampled voltage control signal amplitude 310 to about 200 microseconds, the voltage generator 120 is operable to speed up a cycle time of generating radiation from the radiation source 110, as well as reduce spit effects of the radiation source 110 (e.g., tube) that can otherwise reduces a life of the radiation source 110 and reduces the quality of acquired radiological images. The reduced transient time 305 also decreases opportunities or likelihood of generating undesired, toxic radiation that can be harmful to exposed patients.

An embodiment of the reactive portion 300 generally comprises a conductive plate 312 located a position or distance 315 relative to the linear alignment of the succession of resistors 208, 215, 220, 225, 230, 235, 240, 245, 250 at a distance 320 relative to the grounded enclosure 152 or electrical ground 210. The dimensions of the conductive plate 312 can vary. The introduction of the high frequency range of the voltage potential is dependent on inter alia the surface area (e.g., dimensions of length and width or radial dimension, etc. facing the measurement resistor 190) of the conductive plate 312, the distance 315 of the conductive plate 312 from the measurement resistor 190, and the distance 320 of the conductive plate 312 relative to the electrical housing 152 or electrical ground 210. Thereby, the dimension of the surface area of the conductive plate 312 is dependent, inter alia, on the distance 315 of the conductive plate 302 relative to the linear alignment of the measurement resistor 190.

Referring to FIG. 3, an embodiment of the construction of the voltage divider 150 of the voltage generator 120 comprises a first electrical ground or ground mesh or ground screen 350, a first substrate 355 to mount the reactive bypass portion 300 spaced apart from the ground screen 350, a second substrate 360 to receive or mount the linear succession of resistors 208, 215, 220, 225, 230, 235, 240, 245, 250 spaced apart from the substrate 355, and a second electrical ground or ground mesh or ground screen 365. An embodiment of construction of each of the first electrical ground mesh 350, the first and second substrates 355 and 360, and the second electrical ground mesh 365 is of general planar sheet construction (e.g., printed circuit boards) of insulative material (e.g., ceramic) of construction to withstand high ranges of temperature typically encountered with operation of the high voltage generator 120.

Each of above-described planar sheets that comprise the ground meshes 350 and 365 and first and second substrates 355 and 360 is generally equal length (L1), width (L2) and offset distance (L3) from one another, and are generally arranged according to the above-described sequence in a general stacked configuration electrically coupled together. One or both of the ground meshes 350 and 365 are electrically connected or coupled to the housing 152, which is electrically grounded as illustrated by reference 210. The above-described capacitors 205, 250, 255, 260, 265, 270. 275, and 280, and resistors 208, 215, 220, 225, 230, 235, 240, 245, 250 can be electrically connected via an electrical bond to or solder to one another or to the substrates 355 or 360 in a known manner so as to be generally rigidly located with respect to one another.

Referring to FIG. 4, an embodiment of the construction of one or more of the linear arrangement of resistors 208, 215, 220, 225, 230, 235, 240, 245, 250 generally comprises a layer of resistive material 370 mounted by printing or lithographing or bonding or vapour deposition onto the ceramic material substrate 375 or combination thereof. Although only resistors 208 and 215 are shown, it should be understood that the construction of the remaining resistors 220, 225, 230, 235, 240, 245, 250 is of a similar construction. The resistive material 370 should be of constructed with precision to accurately deliver a desired value of resistance and to withstand increased temperatures associated with operation of the high voltage generator. Various shapes of the layer of resistive material 370 can be placed or mounted onto the ceramic substrate 375. One embodiment (illustrated in solid line) of the shape of the resistive material is generally linear-shaped along its entire length and of a predetermined width. The thickness is such so as not to unduly limit the communication of electrical power therethrough and yet dissipate heat at a minimum rate.

FIG. 5 illustrates another embodiment of the linear arrangement of the resistors 208, 215 of the voltage divider 150. Each resistor 208, 215 generally comprises resistive material 370 of a meandering or sinusoidal shape (similar to a sinusoidal wave) of a predetermined width. The amplitude 380 of meandering shape can vary. Reducing the size of the resistors 208, 215, 220, 225, 230, 235, 240, 245, 250 according to the embodiments thereof shown in FIGS. 4 and 5 generally reduces the introduction or creation of stray capacitance to the divider 150, but must be balanced against the temperature dissipation need and electrical power transmission needs of the high voltage generator 120.

The technical effect of the above-described embodiments of the divider 150 is operable to receive AC or DC electrical power of varying bandwidth and voltage level (e.g., 50 to 250 kV). The divider 150 also operates with precision in a wide temperature range. Hence the subject matter described herein provides a simple, compact, efficient, cost effective and manufacturer friendly construction of a high voltage generator 120 for the radiation generator 105. Furthermore, the above-described embodiments of the high voltage generator 120 allow the use of well-controlled processes employed in manufacturing the insulating construction. For example, a technical effect of the above-described construction of the divider 150 is an ability to operate when immersed in an insulating fluid 400 of the radiation source 110 configured to enhance heat dissipation. One or more of the above-described components of the divider 150 may otherwise be located independent of the insulating fluid 140 or the radiation source 110.

In addition to sampling the high voltages delivered by the high voltage generator 120, a technical effect of the divider 150 includes reducing undesired parasitic effects that may otherwise distort the transient time and accurate measurement of the voltage potentials delivered by the high voltage generator 120 to the radiation source 110.

For example, the build-up of the voltage generator 120 to deliver a pulse of about 100 kilo-volts can last up to about 0.5 to 1 millisecond in duration. Yet, the pulse may include a series of undesired oscillations associated with charging time of the power cables of the voltage generator 120 that may last up to 1.5 milliseconds in duration. The above-described embodiments of the arrangement 160 of the divider 150 can reduce the residual effects of these undesired oscillations and thereby enhance performance of the divider 150 in providing feedback back to the converter 140.

The above-described embodiments of the radiation generator 105, the voltage generator 120, or the divider 150 can be implemented in connection with different applications than that described above (e.g., industrial inspection systems, security scanners, particle accelerators, etc.) where high voltage generators are employed.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A voltage divider of a voltage generator, comprising:
- an input terminal opposite an output terminal;
- a measurement resistor electrically connected in series between the input terminal and the output terminal;
- a footer resistor electrically connected in parallel between the output terminal and electrical ground, a value of the footer resistor at least a magnitude smaller relative to a value the measurement resistor;
- a footer capacitor electrically connected in parallel between the output terminal and electrical ground; and
- a reactive bypass component having a first end electrically connected in parallel to the measurement resistor.

2. The voltage divider of claim 1, wherein the reactive portion comprises a conductive plate located at a spaced distance from the measurement resistor.

3. The voltage divider of claim 2, wherein the measurement resistor is generally comprised of a plurality if individual resistors in general linear alignment relative to one another.

4. The voltage divider of claim 3, wherein each of the plurality of leakage capacitors and the footer capacitor is comprised of a film construction that includes a metallic strip and at least one insulative strip relative thereto.

5. The voltage divider of claim 4, wherein the measurement resistor and the footer resistor are generally linear aligned relative one another.

6. The voltage divider of claim 5, wherein the reactive portion is spaced a distance from an enclosure of the voltage divider electrically connected to ground.

7. A radiation generator, comprising:
- a radiation source operable to generate an electromagnetic radiation, the radiation source comprising an anode and a cathode;
- a voltage generator electrically coupled to provide electrical power to energize the radiation source, the voltage generator comprising:
  - an input terminal opposite an output terminal;
  - a measurement resistor electrically connected between the input terminal and the output terminal;
  - a footer resistor electrically connected in parallel between the output terminal and electrical ground, a value of the footer resistor at least a magnitude smaller relative to a value the measurement resistor;
  - a footer capacitor electrically connected in parallel between the output terminal and electrical ground; and
  - a reactive portion having a first end electrically connected in parallel to the measurement resistor.

8. The radiation generator of claim 7, wherein the reactive portion comprises a conductive plate located at a spaced distance from the measurement resistor.

9. The radiation generator of claim 8, wherein the measurement resistor is generally comprised of a plurality if individual resistors in general linear alignment relative to one another.

10. The radiation generator of claim 9, wherein each of the plurality of supplemental capacitors and the footer capacitor is comprised of a film construction that includes a metallic strip and at least one insulative strip relative thereto.

11. The radiation generator of claim 10, wherein the measurement resistor and the footer resistor are generally linear aligned relative one another.

12. The radiation generator of claim 11, wherein the reactive portion is spaced a distance from an enclosure electrically connected to ground.

13. The radiation generator of claim 12, wherein at least one of the measurement resistor, the footer resister and the footer capacitor is immersed in an insulating fluid.

14. The radiation generator of claim 7, wherein the radiation source is operable to generate x-rays for radiological imaging of a patient.

15. A voltage divider of a voltage generator, comprising:

an input terminal opposite an output terminal;

a measurement resistor electrically connected in series between the input terminal and the output terminal, the measurement resistor comprising a series of spaced apart portions of resistive material electrically connected to one another, the series of spaced apart portions of resistive material located at a generally uniform distance from electrical ground;

a footer resistor electrically connected in parallel between the output terminal and an electrical ground;

a footer capacitor electrically connected in parallel between the output terminal and the electrical ground.

16. The voltage divider of claim 15, further comprising:

a reactive bypass component having a first end electrically connected in parallel to the measurement resistor wherein the reactive portion comprises a conductive plate located at a spaced distance from the measurement resistor.

17. The voltage divider of claim 15, wherein the measurement resistor is coupled to a ceramic substrate.

18. The voltage divider of claim 15, wherein the ceramic substrate is spaced an offset distance from an electrically grounded mesh.

19. The voltage divider of claim 15, wherein the voltage divider is electrically grounded to a housing that encloses the voltage generator.

20. The voltage divider of claim 15, wherein an alignment of each of the portions of the resistive material is one of the group comprising: a linear alignment along an entire length of the portion; and a meandering alignment along an entire length of the portion.

* * * * *